US009469436B1

(12) United States Patent
Keup

(10) Patent No.: US 9,469,436 B1
(45) Date of Patent: Oct. 18, 2016

(54) PARTS CONTAINER WITH STORAGE COMPARTMENTS

(71) Applicant: Steven Jerald Keup, Oshkosh, WI (US)

(72) Inventor: Steven Jerald Keup, Oshkosh, WI (US)

( * ) Notice: Subject to any disclaimer, the term of this patent is extended or adjusted under 35 U.S.C. 154(b) by 0 days.

(21) Appl. No.: 14/725,915

(22) Filed: May 29, 2015

Related U.S. Application Data

(60) Provisional application No. 62/008,233, filed on Jun. 5, 2014.

(51) Int. Cl.

| | |
|---|---|
| ***B65D 25/28*** | (2006.01) |
| ***B65D 25/04*** | (2006.01) |
| ***B65D 21/02*** | (2006.01) |
| ***B65D 43/02*** | (2006.01) |

(52) U.S. Cl.
CPC ..... *B65D 25/04* (2013.01); *B65D 21/0209* (2013.01); *B65D 25/2882* (2013.01); *B65D 43/02* (2013.01)

(58) Field of Classification Search
CPC ..... B65D 25/04
USPC ..... 220/524; 206/508, 510
See application file for complete search history.

(56) References Cited

U.S. PATENT DOCUMENTS 892,969 A * 7/1908 Wilson ..... B65D 25/04 15/257.01
2,985,333 A 5/1961 Kirkman
4,763,782 A 8/1988 Sinchok
4,848,626 A 7/1989 Waters
D315,628 S 3/1991 Newarski
5,593,061 A * 1/1997 Prochnow ..... A01K 97/06 206/315.11
6,230,584 B1 * 5/2001 Lin ..... B62M 3/086 74/594.6
D624,313 S 9/2010 Mitchell
8,006,842 B1 * 8/2011 Loughlin, Jr. ..... B65D 1/36 206/449
2007/0241020 A1 * 10/2007 Anderson ..... B65D 21/0209 206/510

OTHER PUBLICATIONS

Leather Discount Goods, Quality Leather Goods and So Much More, viewed on Apr. 23, 2014 at http://www.leatherdiscountgoods.com/docs/Other%20Gift%20Items.htm, image shown on right side on p. 2 of 15.

* cited by examiner

*Primary Examiner* — Stephen Castellano
(74) *Attorney, Agent, or Firm* — Brannen Law Office, LLC

(57) ABSTRACT

The present invention relates to a parts container with storage compartments, and in particular to a parts container having storage compartments located at areas that would be easily accessible to persons working with automobiles. The container has a body with several top compartments or cavities. There are preferably four front compartments, four middle components and four rear compartments. A bottom compartment can be provided. A handle is further provided. The handle has writing areas for a user to place messages on the handle (such as names, due dates, etc.). The handle of one container can nest in the bottom compartment of another container when stacked. A cover having a perimeter shaped to match the container perimeter is provided. The cover has an opening to allow the handle to pass there through. The handle is preferably located interior of the compartments.

15 Claims, 6 Drawing Sheets

PARTS CONTAINER WITH STORAGE COMPARTMENTS

This United States utility patent application claims priority on and the benefit of provisional application 62/008,233 filed Jun. 5, 2014, the entire contents of which are hereby incorporated herein by reference.

BACKGROUND OF THE INVENTION

1. Field of the Invention

The present invention relates to a parts container with storage compartments, and in particular to a parts container having storage compartments located at areas that would be easily accessible to persons working with automobiles.

2. Description of the Related Art

Containers come in many shapes and sizes. In some circumstances, containers are made specifically to hold parts. Parts containers in the most basic sense could be comprised of an open box like structure in which parts such as screws and bolts can be held. One problem with this type of container is that there are no divisions or dividers that can segregate the parts.

U.S. Pat. No. 2,985,333 to Kirkman discloses a plastic cabinet drawer with removable partitions. While a device such as the one disclosed in this patent may solve the problems associated with a lack of partitions, it can nevertheless be improved upon.

U.S. Pat. No. Des. 315,628 to Newarski is titled Container for Auto Parts. While the product shown in this patent may work well for its intended purposes, it too can be improved upon.

Neither of the products described above show a handle for use with the container.

None show parts containers that are stackable with a handle in place. Related, none show a bottom with a bottom cavity shaped to receive a handle of another container.

None show a handle with one or more writing areas for a person to write on.

None show a form fitting cover. Related, none show a cover that can be used with a handle and used when the containers are stacked.

None show a handle that is located interior of all cavities or compartments whereby the handle is located near or at the center of gravity of the parts container.

Thus there exists a need for a parts container that solves these and other problems.

SUMMARY OF THE INVENTION

The present invention relates to a parts container with storage compartments, and in particular to a parts container having storage compartments located at areas that would be easily accessible to persons working with automobiles. The container has a body with several top compartments or cavities. There are preferably four front compartments, one for the bumper and the hood, one for core support and one for each front fender. There are preferably four middle components including one for each of four doors. There are preferably four rear compartments including one for the rear bumper, one for the trunk lid or lift gate and one for each of the rear quarter panels. A bottom compartment can be provided. A handle is further provided. The handle has writing areas for a user to place messages on the handle (such as names, due dates, repair orders, etc.). The handle of one container can nest in the bottom compartment of another container when stacked. A cover having a perimeter shaped to match the container perimeter is provided. The cover has an opening to allow the handle to pass there through.

According to one advantage of the present invention, the parts container has a handle allowing for easy transport of the container.

According to another advantage of the present invention, the handle can have a front writing area and a rear writing area. The areas can be made of a material such as dry erase board or white board wherein information such as customer name, due date, status and other information or instructions can be written. The written areas are viewable from the ends of the container.

According to another advantage of the present invention, the containers are stackable or nestable. Each container has a bottom compartment that fits over the handle of a second container that the first container is being stacked upon. This nesting ability allows for high density storage. The bottom of the container is preferably generally flat.

According to another advantage of the present invention, the container has a cover that allows the handle to pass through yet that covers all of the top compartments. This ensures that parts will not inadvertently escape the compartments if the container is bumped.

According to another advantage of an embodiment of the present invention, the cover can have four distinct and independent pieces. In this regard, the cover can be opened only over selected compartments with the other compartments remaining covered.

Related, the containers are stackable even when the cover is in place. Hence, the covers do not appreciably affect the density of the storage.

According to a still further advantage of the present invention, the handle is located interior of all cavities or compartments. The handle therefore is located near or at the center of gravity of the parts container allowing for easier transport with greater stability. Also, each of the parts compartments are located about the perimeter of the container (or between the perimeter and the handle) allowing for easier access to the compartments as the handle does not interfere with access to the respective compartments.

According to a still further advantage of the present invention, the parts containers are located at easily accessible and recognizable locations. The container has the shape of a generic four door vehicle or automobile. For example, the compartments for door parts are located at locations within the container where doors would be on the vehicle. These segregated locations allow for parts to be stored in locations that are easily recognized and remembered. Hence, the people using the container can save time by having parts sorted and organized in an effective manner. In this regard, the parts for the various locations are located where one could quickly and logically find them.

According to another advantage of the present invention, both the handle and the bottom compartment are generally H-shaped. This advantageously allows nested containers to be laterally and longitudinally stable.

Other advantages, benefits, and features of the present invention will become apparent to those skilled in the art upon reading the detailed description of the invention and studying the drawings.

DETAILED DESCRIPTION OF PREFERRED EMBODIMENTS

Figure 1:
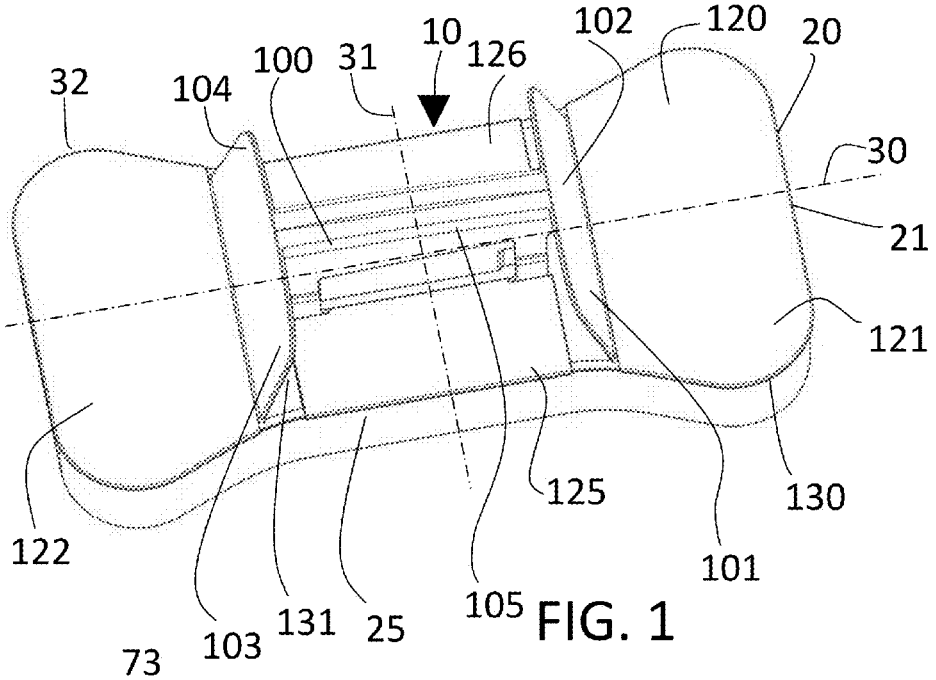
FIG. 1 is a perspective view of a preferred embodiment of the present invention with a handle and cover in place.
Figure 2:
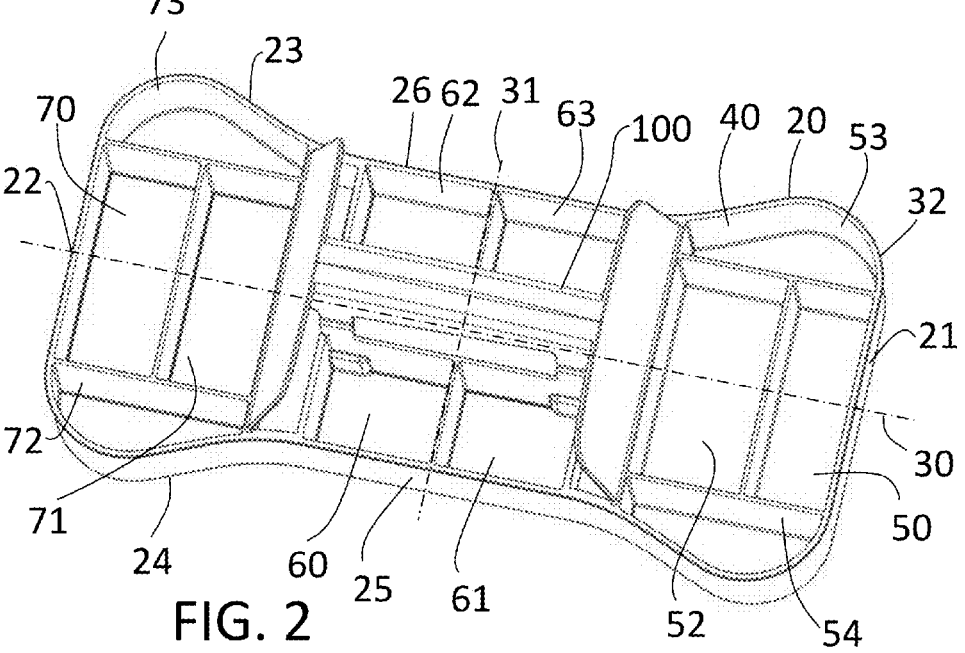
FIG. 2 is a perspective view of a preferred embodiment of the present invention with a handle in place.

While the invention will be described in connection with one or more preferred embodiments, it will be understood that it is not intended to limit the invention to those embodiments. On the contrary, it is intended to cover all alternatives, modifications and equivalents as may be included within the spirit and scope of the invention as defined by the appended claims.

Turning now to FIGS. 1-11, it is seen that several preferred embodiments of the present invention are illustrated. The present invention is a parts container 10 having a body 20. A handle 100 and a cover 120 can be included with the body.

The body 20 has a front 21, a rear 22, a top 23, a bottom 24 and two sides 25 and 26. The body further has a longitudinal axis 30 and a lateral axis 31. A perimeter 32 is further provided. The body can be made of plastic. However, other materials and a number of manufacturing techniques could be used without departing from the broad aspects of the present invention. In one embodiment, the container is approximately 24 inches long and approximately 12 inches wide. However, other dimensions may be used without departing from the broad aspects of the present invention. The perimeter 32 has a shape of a generic four door automobile. Yet, other shapes, such as for other vehicles (passenger or commercial vehicles, bikes and trikes for example) could be utilized without departing from the broad aspects of the present invention. The body preferably has a constant depth, and the top 23 and bottom 24 (not including compartments) are preferably generally flat.

A plurality of top compartments 40 or cavities are provided.

There can be four front compartments 50, 52, 53 and 54 respectively. Compartment 50 can be for a bumper and hood. Compartment 52 can be for core support. Compartments 53 and 54, respectively, can be for the fenders. It is appreciated that compartment 50 could be separated into two separate compartments if desired to segregate pieces for the bumper and hood.

There are also preferably four compartments 60, 61, 62 and 63 for door parts. In this regard, there are two compartments on each side of the container 10 including one compartment for each of four doors that are common on automobiles.

There are also preferably four rear compartments 70, 71, 72 and 73. Compartment 70 can hold parts for the rear bumper. Compartment 71 can hold parts for the trunk lid or lift gate. Compartments 72 and 73 can hold parts for the left and right rear quarter panels, respectively.

It is appreciated that while specific embodiments of compartments are illustrated herein, that other compartments could be used, including more or fewer compartments, without departing from the broad aspects of the present invention.

A bottom compartment 80 is further provided. The bottom compartment 80 preferably has a general H shape, with the web of the H being aligned along the longitudinal axis 30 and the flanges being aligned parallel to the lateral axis 31 of the body 20.

Figure 5:
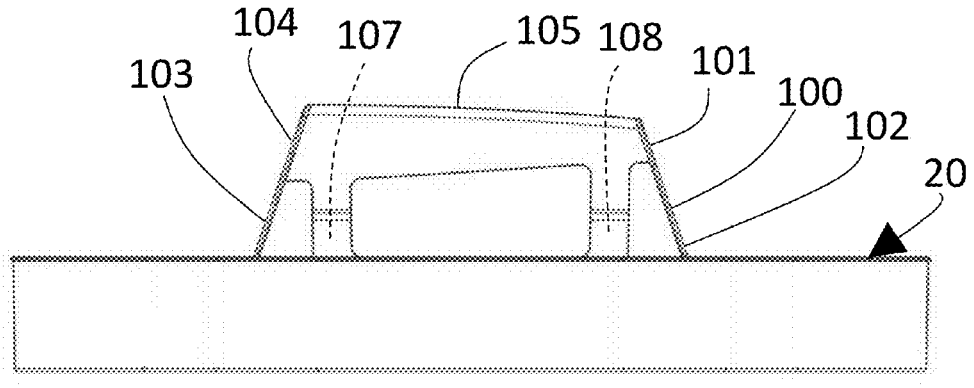
FIG. 5 is a side view of the preferred embodiment shown in FIG. 2.

A handle 100 is further provided as best seen in FIGS. 1, 2 and 5-8. The handle has a front 101 with a writing area 102 thereon. The writing area can be made of white board, dry erase board or another surface that allows for messages to be written thereon (such as names, due dates, instructions, repair orders, etc.). A rear section 103 also with a writing area 104 is further provided. A bridge 105 is between the front 101 and rear 103 of the handle. The bridge is preferably aligned along the longitudinal axis 30 of the body 20. The front 101, rear 103 and bridge 105 are preferably integrally formed with each other and preferably have a generally H shaped profile. The front 101 and back 103 can be angled towards each other as they rise to the bridge 105 as best seen in FIG. 5. The front 101 can have an interior region 107 and the back 103 can have an interior region 108. The regions 107 and 108 provide clearance for handles of stacked containers.

The top compartments 40 are located between the perimeter 32 and the handle 100. In this regard, the compartments are easily accessible without interference from the handle. Further, the perimeter weight added by the parts adds to the stability of the container. The handle 100 is preferably located on the center of gravity of the container 10 both side to side and front to back.

Figure 6:
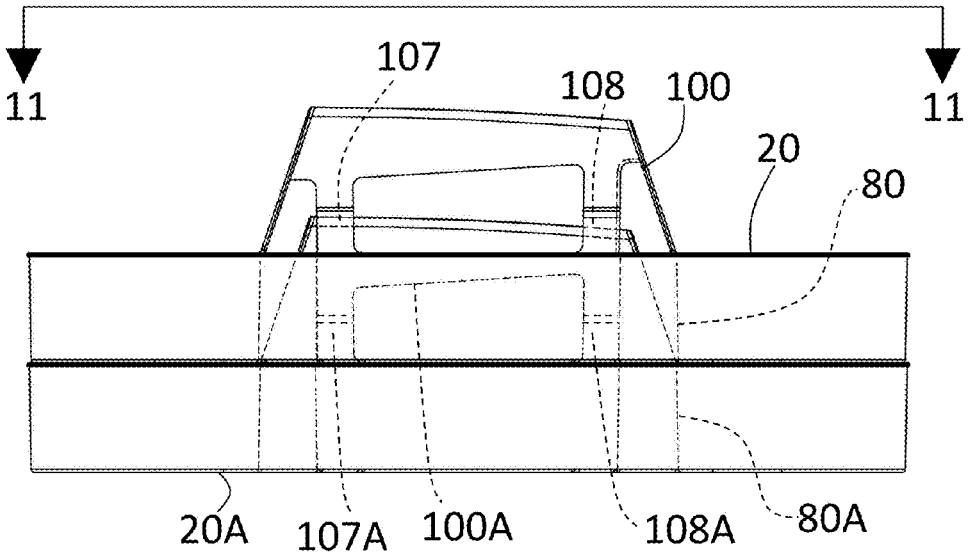
FIG. 6 is a side view showing two containers stacked.
Figure 7:
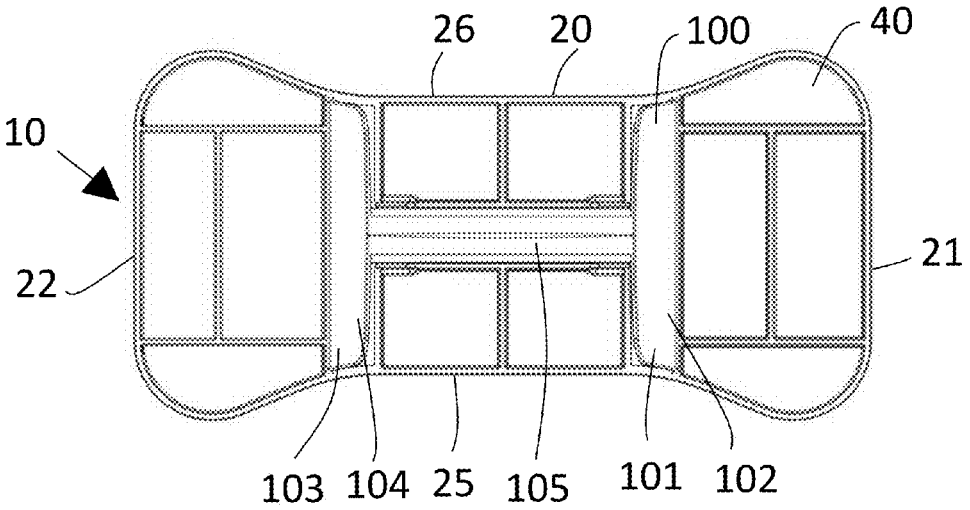
FIG. 7 is top view showing a container and handle.
Figure 8:
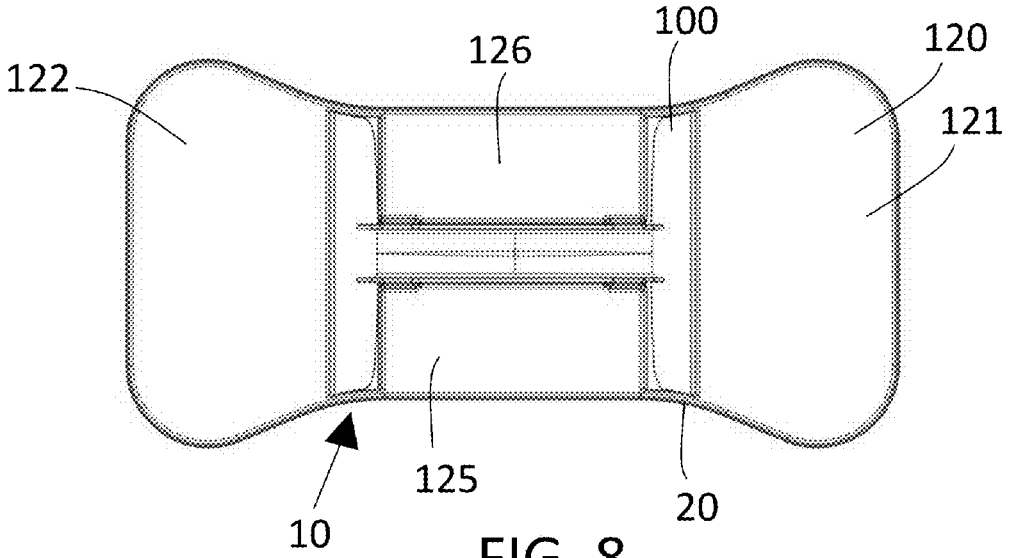
FIG. 8 is similar to FIG. 7 but also shows a cover.
Figure 11:
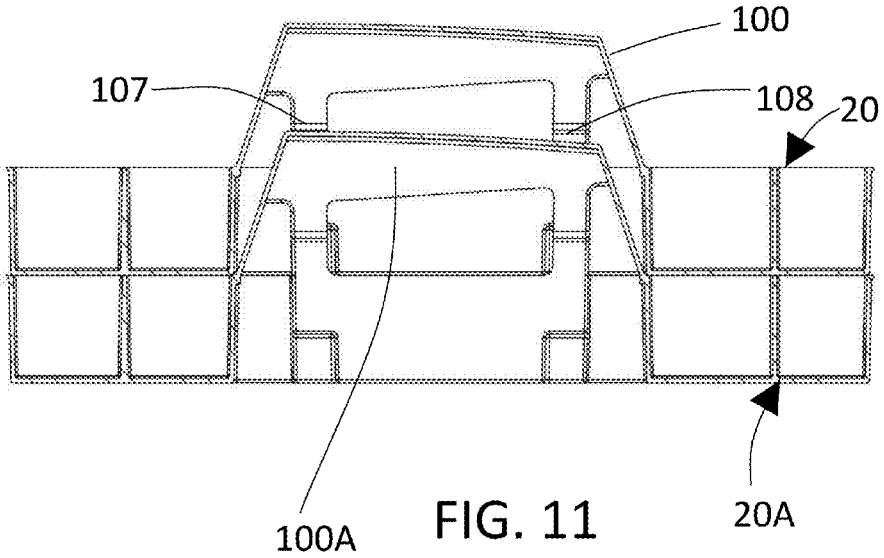
FIG. 11 is a cross-sectional view taken along line 11-11 in FIG. 6.

When two containers 20 and 20A are stacked as seen in FIGS. 6 and 11, the handle 100A of the bottom container 20A is fully received within the bottom compartment 80 of the top container 20 and the regions 107 and 108 of the handle 100, whereby the two containers stack generally flat relative to each other. The H-shaped handle and bottom compartment provide for longitudinally and laterally stable stacking. The second body 20A has a handle 100A with regions 107A and 108A and a bottom compartment 80A. Further, the width of the flanges of the bottom compartment are wide enough to accommodate the sloped or racked orientation of the handle ends.

Further, in an alternative embodiment, the regions can be eliminated if the height of the handle is less than the depth of the bottom compartment or cavity.

A cover 120 can further be provided and is preferably thin and flat. The cover 120 can have a front, a rear, a top, a bottom and two sides. The cover can have four separate sections or pieces, or can be a single integral piece. For simplicity, even if multiple pieces are present, it can be described as a cover. The front, rear and sides define a perimeter 130. The perimeter 130 preferably matches the perimeter of the body 20. A hole or opening 131 passes through the cover 120. The shape of the opening 131 is preferably generally H shaped.

The cover 120 preferably has a plurality of distinct pieces or sections including a front piece or section 121 for covering the front compartments, a rear piece or section 122 for covering the rear compartments, a first side piece or section 125 for covering the first side compartments and a second side piece or section 126 for covering the second side compartments. The four pieces of the cover 120 are operable independent of each other and each can snap onto the body at the perimeter. While the cover is shown as having four pieces, it is understood that the cover could be a single unitary and planar cover without departing from the broad aspects of the present invention wherein the cover could be removed as a unit from the body 20.

The handle 100 extends up vertically through the cover 120 when the cover is in place. The cover lays flat on the body 20 and covers all of the top compartments 40. Since the cover is flat, it does not interfere with stacking or nesting of containers 10. The writing areas 102 and 104 are still exposed to exterior view when the cover is in place on the body 20. Looking now in FIGS. 6 and 11, it is seen that in an embodiment where the handle is taller than the body, the handle can be received within voids or spaces in the interior of the handle of the adjacent container wherein the containers can nevertheless stack in a flat manner.

Figure 3:
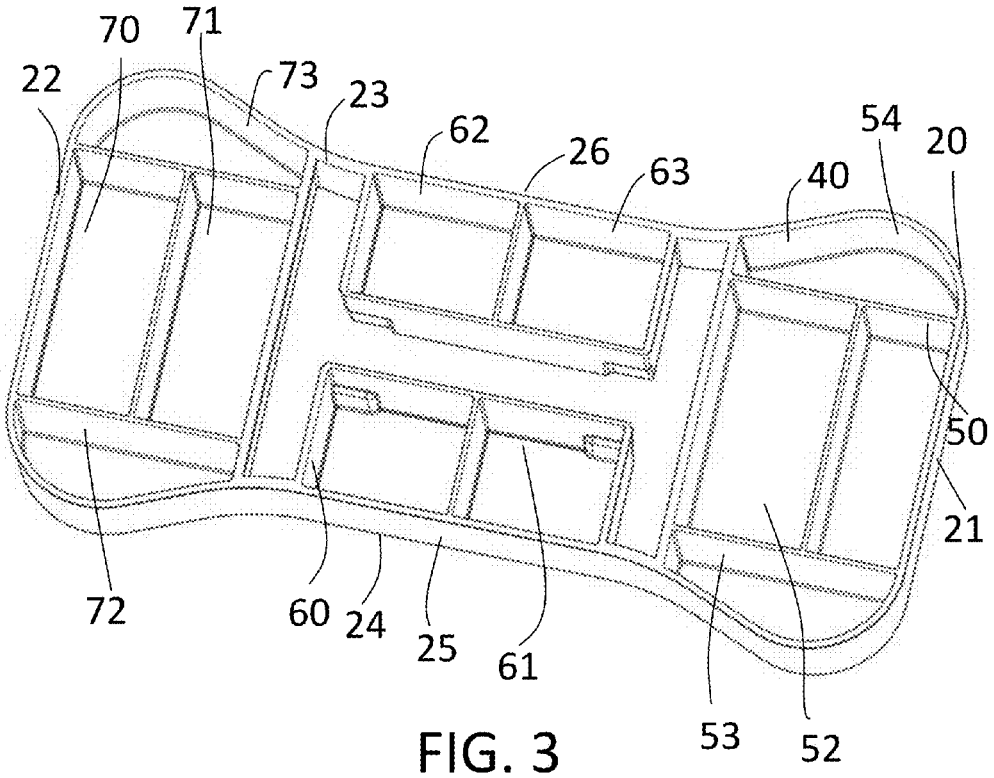
FIG. 3 is a perspective view of a preferred embodiment of the present invention without a handle or cover.
Figure 4:
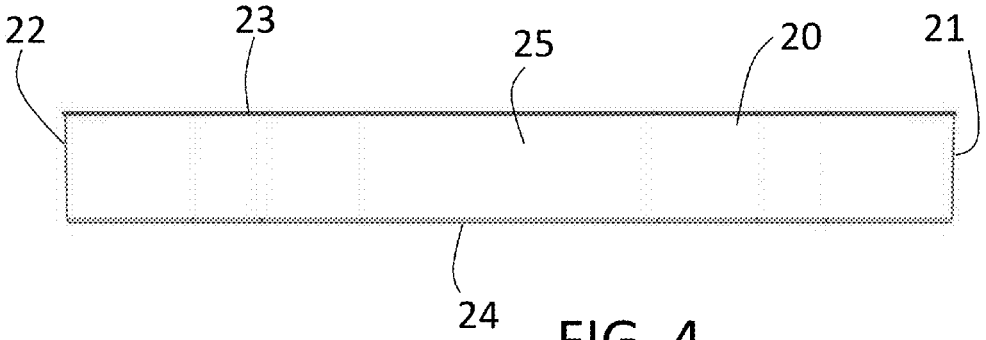
FIG. 4 is a side view of the preferred embodiment shown in FIG. 3.
Figure 9:
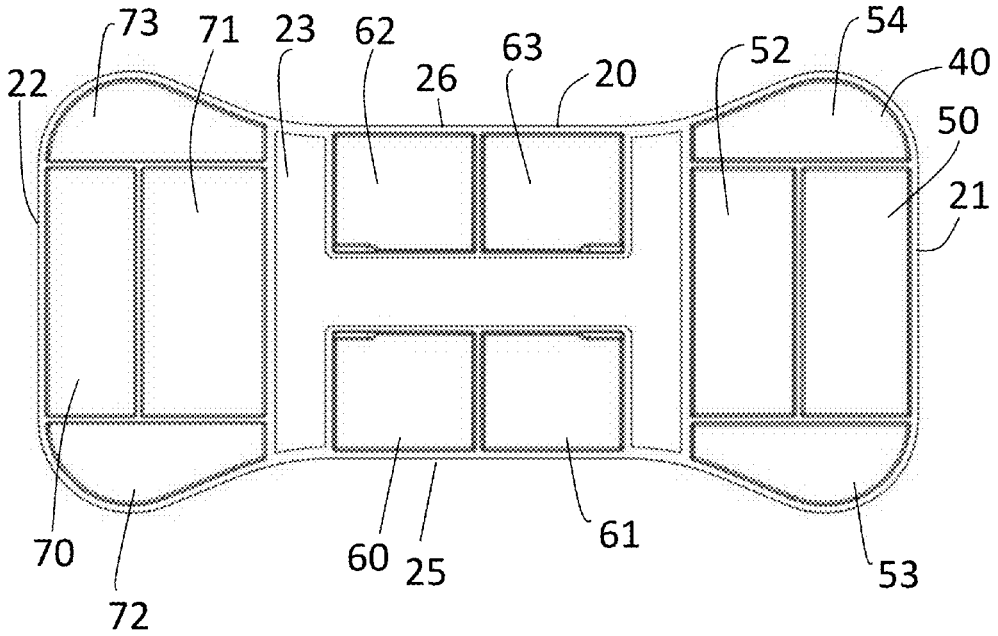
FIG. 9 is similar to FIGS. 7 and 8 but shows a container without a handle or cover.
Figure 10:
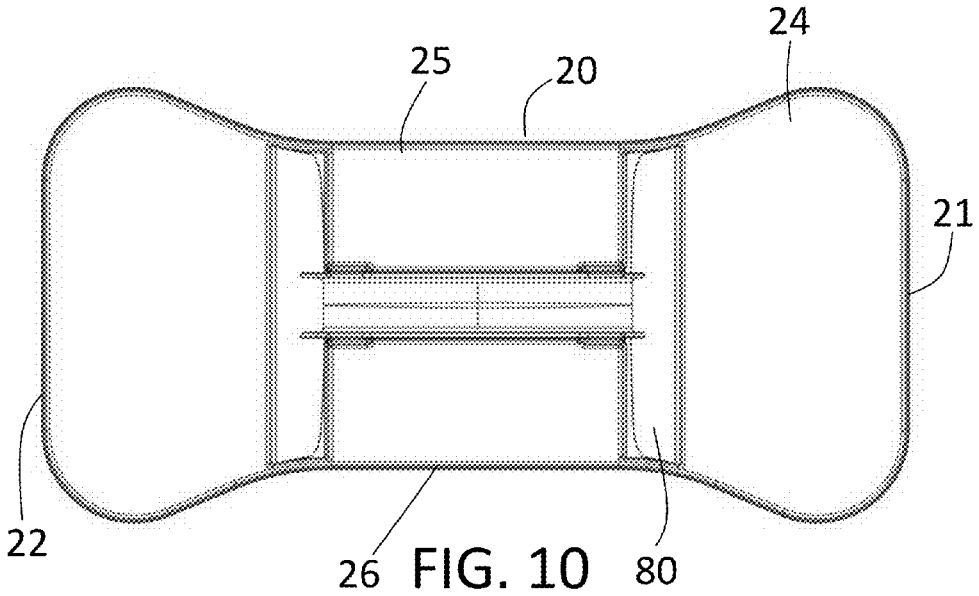
FIG. 10 is a bottom view of a preferred embodiment of the present invention.

Looking at FIGS. 3, 4 and 9, it is seen that an embodiment without a handle is illustrated. In this embodiment, the remaining parts of the container can remain the same as the earlier described embodiments and the other advantages of the present invention can be maintained.

Thus it is apparent that there has been provided, in accordance with the invention, a parts container that fully satisfies the objects, aims and advantages as set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. A parts container comprising:

a body with a top and a bottom, said top defining at least one top compartment and said bottom defining a bottom compartment, said bottom compartment being a generally H-shaped bottom compartment that is open to said bottom of said body;

a handle upstanding from said body, said handle being in a fixed position relative to said body and being a generally H-shaped handle; and a cover selectably covering said at least one top compartment, wherein said generally H-shaped handle is smaller than said generally H-shaped bottom compartment whereby said parts container is stackable, such that said generally H-shaped bottom compartment is adapted to receive a generally H-shaped handle of a parts container stacked therebelow.

2. The parts container of claim 1 wherein said handle extends above said cover.

3. The parts container of claim 1 wherein said at least one top compartment comprises:

at least one front compartment;

at least one first side compartment;

at least one second side compartment; and at least one rear compartment.

4. The parts container of claim 3 wherein said cover covers each of said at least one front compartment, said at least one first side compartment, said at least one second side compartment and said at least one rear compartment.

5. The parts container of claim 1 wherein said body has a center of gravity and said handle is located on said center of gravity.

6. A parts container comprising:

a body with a top having at least one front compartment, at least one first side compartment, at least one second side compartment, at least one rear compartment, and a bottom with a bottom compartment that is open to said bottom and that is a generally H-shaped bottom compartment; and a handle upstanding from said body, said handle being a stationary handle relative to said body and being a generally H-shaped handle, wherein said generally H-shaped handle is smaller than said generally H-shaped bottom compartment and said parts container is stackable with a second like-shaped parts container, such that said generally H-shaped bottom compartment is adapted to receive a generally H-shaped handle of said second like-shaped parts container stacked therebelow.

7. The parts container of claim 6 further comprising a cover, wherein said cover has:

a first section to cover said at least one front compartment;

a second section to cover said at least one first side compartment;

a third section to cover said at least one second side compartment; and a fourth section to cover said at least one rear compartment.

8. The parts container of claim 6 wherein said handle is interior of said at least one front compartment, said at least one first side compartment, said at least one second side compartment and said at least one rear compartment.

9. The parts container of claim 6 wherein said body has a center of gravity and said handle is located on said center of gravity.

10. The parts compartment of claim 6 wherein said handle has at least one writing area.

11. A parts container comprising:

a body with a plurality of top compartments, a bottom compartment and a perimeter; and a handle that is a generally H-shaped handle that is fixed in position relative to said body, wherein said plurality of top compartments are located between said perimeter and said handle, wherein said bottom compartment is open to a body bottom and is a generally H-shaped bottom compartment, said generally H-shaped bottom compartment being similar in size to but larger than said generally H-shaped handle whereby said parts container is a stackable parts container, such that said generally H-shaped bottom compartment is adapted to receive a generally H-shaped handle of a parts container stacked therebelow.

12. The parts container of claim 11 wherein:

said handle upstands form said body;

said body has a center of gravity; and said handle is located on said center of gravity.

13. The parts container of claim 11 wherein said handle has at least one writing area.

14. The parts container of claim 11 further comprising a cover, said handle extends above said cover.

15. The parts container of claim 11 wherein said plurality of top compartments comprises:

at least one front compartment;

at least one first side compartment;

at least one second side compartment; and at least one rear compartment.

* * * * *